United States Patent [19]

Miyazawa et al.

[11] Patent Number: 4,797,119

[45] **Date of Patent: * Jan. 10, 1989**

[54] INSULATION DISPLACEMENT CONNECTION (IDC) TYPE CABLE CONNECTOR AND A METHOD FOR ASSEMBLING A CABLE THERETO

[75] Inventors: Hideo Miyazawa; Ikuhiro Andoh, both of Yokohama; Hiromichi Koyama, Suzaka; Mitsuru Kobayashi, Nagano, all of Japan

[73] Assignee: Fujitsu Limited, Kawasak, Japan

[ * ] Notice: The portion of the term of this patent subsequent to Dec. 22, 2004 has been disclaimed.

[21] Appl. No.: 135,708

[22] Filed: Dec. 21, 1987

Related U.S. Application Data

[63] Continuation of Ser. No. 011,601, Feb. 6, 1987, Pat. No. 4,714,306.

[30] Foreign Application Priority Data

Feb. 7, 1986 [JP] Japan ..... 61-025005

[51] Int. Cl.⁴ ..... H01R 4/24

[52] U.S. Cl. ..... 439/395

[58] Field of Search ..... 439/391–422

[56] References Cited

U.S. PATENT DOCUMENTS 3,701,082 10/1972 Baumanis ..... 339/61
4,296,988 10/1981 Warner ..... 339/97

FOREIGN PATENT DOCUMENTS 0034433 8/1981 European Pat. Off. .
0154387 9/1985 European Pat. Off. .
2545791 5/1976 Fed. Rep. of Germany .

*Primary Examiner*—Joseph H. McGlynn
*Attorney, Agent, or Firm*—Staas & Halsey

[57] ABSTRACT

An IDC type multi-conductor cable connector and method for assembling a cable thereto. The cable connector has a plurality of contact terminals mounted in respective holes in a housing having a plurality of holes. The contact terminals each have a contact part provided at one end and an IDC type connection part provided at the other end thereof. The connector has means for temporarily holding the contact terminals in a position where the connection part of each terminal is exposed. The connector can be transported or delivered from the vendor in this state. A cable is assembled by IDC assembling to each exposed connection part. After the connection of the cables has been completed, the contact terminals are inserted further into their respective holes so that the connecting parts become entirely covered. Such configuration eliminates the need for a cover, a component which is necessary for ordinary IDC type connector, and enables reduction in the size of the connector and in labor costs. Such housing may be used in modular form. By combining such modular housings, it is possible to construct various type of connectors merely by changing the case used to combine the modules. Such combined connectors are easy to wire at the interior portions of the cable connector. So, high packing density multi-contact connectors are provided.

12 Claims, 7 Drawing Sheets

INSULATION DISPLACEMENT CONNECTION (IDC) TYPE CABLE CONNECTOR AND A METHOD FOR ASSEMBLING A CABLE THERETO

This is a continuation of co-pending application Ser. No. 011,601 filed on Feb. 6, 1987, now U.S. Pat. No. 4,714,306.

BACKGROUND OF THE INVENTION

The present invention relates to cable connectors having a plurality of contacts for connection with a multi-conductor cable. More particularly the invention involves a cable connector which is suitable for having cables connected thereto by the insulation displacement connection method and a method for assembling a cable and the connector.

Recent progress in the design of electronic equipment has increased the demand for small size cable connectors to which cables may be easily connected. A cable assembling method known in the art as the insulation displacement connection (IDC) method is increasingly being used. The IDC assembly method allows the cables to be connected to the connector without removing the insulation coating from the cables. In IDC assembling, a connection part is provided on the connector for connection to the cable. The connection part is provided with blades which pierce through the cable coating and bite into the core wire of the cable to make electric contact therewith when the cable is pressed against the terminal. So, connection of the cable to a contact terminal for the cable is accomplished by simply pressing the cable against the contact terminal.

Various type of connectors useful for IDC assembling have been developed. These have been classified into two types. The first type, as shown in FIG. 1, uses a contact terminal 1 which is fixed to the cable 2 by crimping, and then the contact terminal is inserted into a housing 3 of the cable connector and fixed therein by known means. An example of such connector is disclosed in U.S. Pat. No. 4,323,296 of Andoh. In this type of connector, the necessary number of contact terminals 1 must be prepared for each of the connectors. Such preparation is troublesome both for vendors and users who handle many such cable connectors.

On the other hand, as shown in FIG. 2, the second type of prior art connector is provided with contact terminals 1 mounted in a housing 3. The necessary number of contact terminals 1 are arranged in the housing 3 so that the trouble mentioned above with respect to the first type of connector is eliminated, and assembling of the cable 2 is accomplished simply by pressing the cable 2 into the contact terminal 1. However, in such an arrangement, the contact terminals 1 must be covered by a cover 4, because bare contact terminals are undesirable for safety reasons as well as reliability of the connector. This makes it difficult to reduce the size of the connector, and additional assembly time and equipment is required for fixing the cover 4 in position.

SUMMARY OF THE INVENTION

A general object of the present invention, therefore, is to provide a cable connector that is small in size and facilitates assembly of a cable therewith. More precisely, it is an object of the present invention to provide a cable connector which has contact terminals mounted in a housing in a manner suitable for IDC assembling, and wherein after the cable is assembled to the connector, there is no need for the contact terminals to be covered using a special cover.

Another object of the present invention is to provide a method for assembling the cable and said cable connector.

A further object of the invention is to provide a modular housing for the cable connector to enable fabrication of a variety of complex cable connectors by combining the modules.

According to the present invention, the cable connector is composed of metal contact terminals and a housing holding the terminals in position. First, each contact terminal is temporarily held by inventive spring action in a first position in the housing. In the first position of the contact terminals, a connector part of the contact terminal for engaging the cable is exposed by the housing. Thus, it is easy to press the cable into the connection part for connection thereto by IDC assembly. Such state is called the pre-load state, and the process for setting the contact terminals in such first position is hereinafter referred to as pre-loading. The cable connectors are supplied to the user in such pre-loaded state, and thus the above mentioned problems, such as preparing the necessary number of the contact terminals for each connector, are avoided.

When the cable is pressed into the connection part, the blades formed on the contact terminal pierce through the insulation coating of the cable and bite the core wire of the cable to make electric contact therewith. At the same time, the holding members provided on the contact terminal embrace the cable to tightly affix the cable to the contact terminal. This is similar to the manner in which ordinary IDC assembling is accomplished.

When the fixing of the cable to the contact terminal is finished, the contact terminal is pushed into the housing and is fixed therein in a second position. In this second position, the connection part of the contact terminals which had been exposed by the housing during preloading is inserted into a hole in the housing, and it thus becomes entirely covered by the housing without using a special cover. At the same time, the other end of the contact terminal, which may be either a male or female cable connector, is put into a position to complete the formation of the cable connector.

By adopting such configuration, all of the problems described above are eliminated and a cover for the connection parts becomes unnecessary, whereby the size of the connector may be smaller than that of prior art connectors. Moreover, such configuration of the cable connector makes it possible to form the housing as a module, and by proper combination of the housing modules, it is possible to form various shaped cable connectors, such as flat or rectangular connectors, for example. It is also possible to vary the number of cables to be connected to the cable connector.

Furthermore, such configuration makes it easy to wire the cables into the connector, whereby a high packing density connector having a plurality of contacts is provided.

These and other objects and advantages of the invention will become apparent from the following detailed desription of preferred embodiments taken in connection with the accompanying drawings.

BRIEF DESCRIPTION OF THE DRAWINGS

FIG. 4(*b*) is a front view of the housing seen from the direction of arrow B in FIG. 4(*a*).

Throughout the drawings, the same or similar reference numerals are used to designate the same or corresponding parts.

DETAILED DESCRIPTION OF THE PREFERRED EMBODIMENTS

Figure 3:
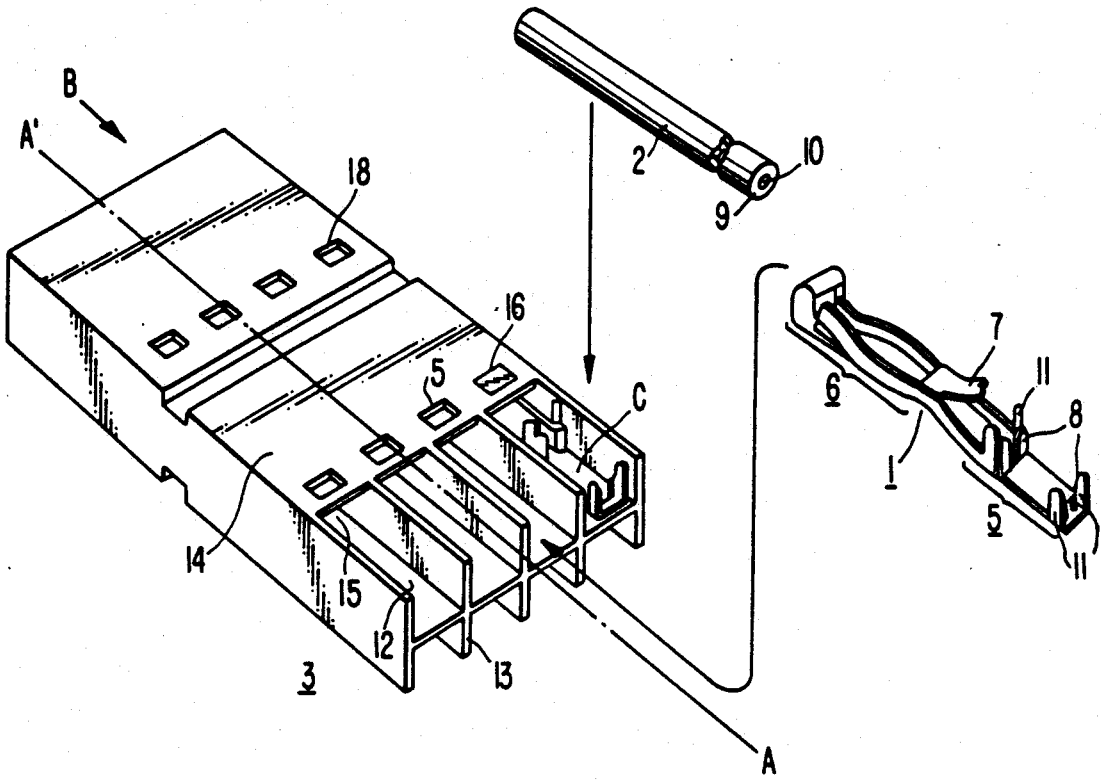
FIG. 3 is an exploded view illustrating the overall configuration of a cable connector embodying the present invention.

FIG. 3 illustrates an overall configuration of a cable connector embodying the present invention. The cable connector of the present invention is composed of contact terminals 1 for making electric contact to respective cables 2, and a housing 3 for mounting the contact terminals 1.

The contact terminals 1 are made of metal, copper alloy for example, and are formed by stamping. One end of each contact terminal 1 comprises a connection part 5 which connects with a cable 2, while the other end of each contact terminal 1 comprises either a male or female jack 6 which engages with a corresponding female socket or male plug (not shown). This latter part 6 will be referred to hereinafter as a contact part. Each contact terminal 1 is provided with a centrally located, elongated leaf spring 7. In FIG. 3, the jacks 6 are shown as female jacks, but it will be apparent that jacks 6 may as well be a male jacks. In the explanation hereinafter, the description will be carried on with respect to female jacks.

Each connection part 5 is provided with blades 8 which pierce through the insulation coating 9 of the cable 2 when the cable is pressed toward the connection part 5, and the blades 8 bite into the core wire 10 of the cable 2 to make electrical contact therewith. Connection parts 5 are further provided with holding members 11, which are bent to embrace the cable to tightly fix it to the contact terminal 1. The shape and structure of connection parts, such as the connection parts 5, which are suitable for IDC assembly, and the shape of the male or female jacks 6 are conventional, so further description is omitted for the sake of simplicity.

Figure 4A:
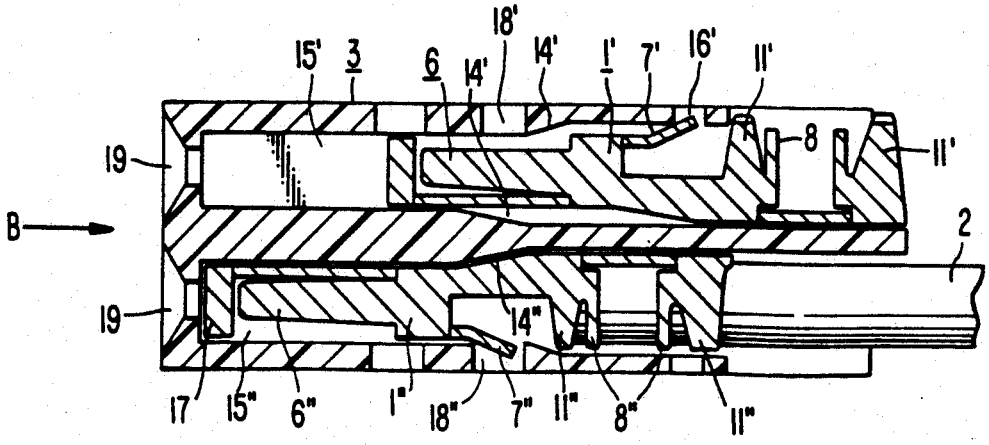
FIG. 4(*a*) is a schematic sectional view taken substantially along line A—A' in FIG. 3, and illustrating the first position and the second position of the contact terminal in the housing.
Figure 4B:
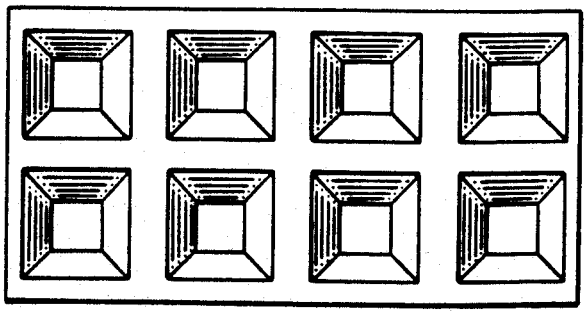

Housing 3 is made of an insulating material, plastic for example, and may be fabricated by injection molding for example. Housing 3 is formed to appear like an harmonica as shown in FIG. 3. FIG. 4(*b*) shows a front view of the housing 3, as seem from the direction of the arrow B in FIG. 3. As can be seen in FIG. 3, the upper wall 14 of housing 3 is cut away at one end of the housing so as to form a respective open deck 12 disposed in front of each opening or hole 15 into which the contact terminals 1 are to be inserted. The open decks 12 are separated from each other by partition walls 13. The length of each deck 12 is substantially equal to the length of the connection part 5 of the contact terminal 1. The widths of the decks 12 and the holes 15 are about the same as the width of the contact terminal 1, and the height of each hole 15 is slightly less than the height of holding members 11 before bending. Therefore, when a contact terminal 1 is inserted into its hole 15 with contact part 6 leading the way, the terminal does not go into hole 15 further than the position indicated by the reference character C in FIG. 3, where connection part 5 is exposed on the open deck 12. Such position is referred to as the first position.

A window 16 is provided in upper wall 14 of the housing adjacent each opening 15 as show in FIG. 3. Leaf spring 7 is initially disposed higher than the lower surface of wall 14, but it can be compressed and bent downwardly by upper wall 14 as contact terminal 1 is pushed into hole 15. When contact terminal 1 reaches its first position, the distal end of leaf spring 7 is urged upwardly into window 16. Window 16 is positioned in upper wall 14 for catching spring 7 in such a manner, and when the end of spring 7 is thus engaged in window 16, the contact terminal 1 cannot be pulled out of the housing without first pushing spring 7 downwardly through window 16.

The relationship of contact terminal 1 and housing 3 can be seen more clearly in FIG. 4(*a*), which presents a cross-sectional view of the connector taken substantially along the line A—A' in FIG. 3. In FIG. 4(*a*), contact terminal 1' is shown at its first position in upper hole 15' while contact terminal 1'' is shown at its second position in lower hole 15'', a condition which will be described hereinbelow. It will be clear from FIG. 4(*a*) that contact terminal 1' is held in its first position by spring 7' which is engaged in upper window 16' and by holding member 11' which is initially taller than height of hole 15'. Thus, contact terminal 1' is stopped by the holding member 11' and prevented from going further into the upper hole 15', and it is prevented from going backwards by spring 7'. The wording "upper" and "lower" are used to identify the parts in the FIG. 4(*a*). However, in practice, the upper and lower segments of housing 3 are formed similarly to each other, so the distinction between upper and lower is meaningless.

Figure 1:
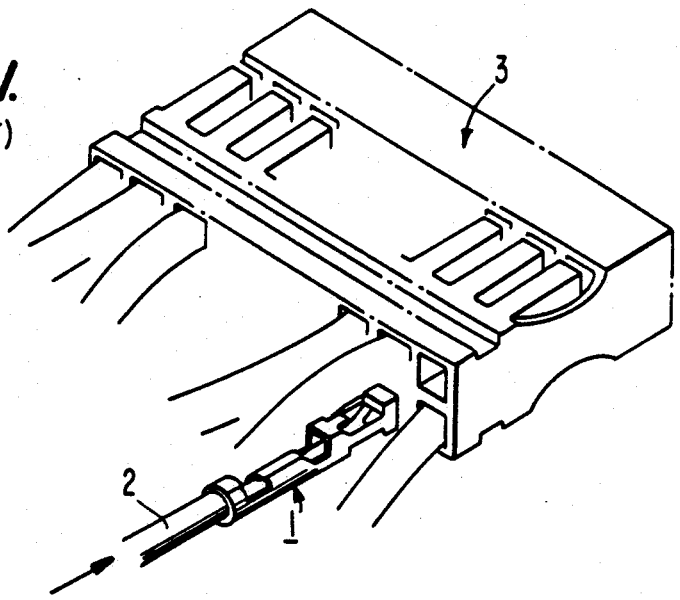
FIG. 1. (PRIOR ART)
FIG. 1 shows a prior art cable connector wherein the contact terminals are inserted into the housing after the individual cables are fixed to respective contact terminals.
Figure 2:
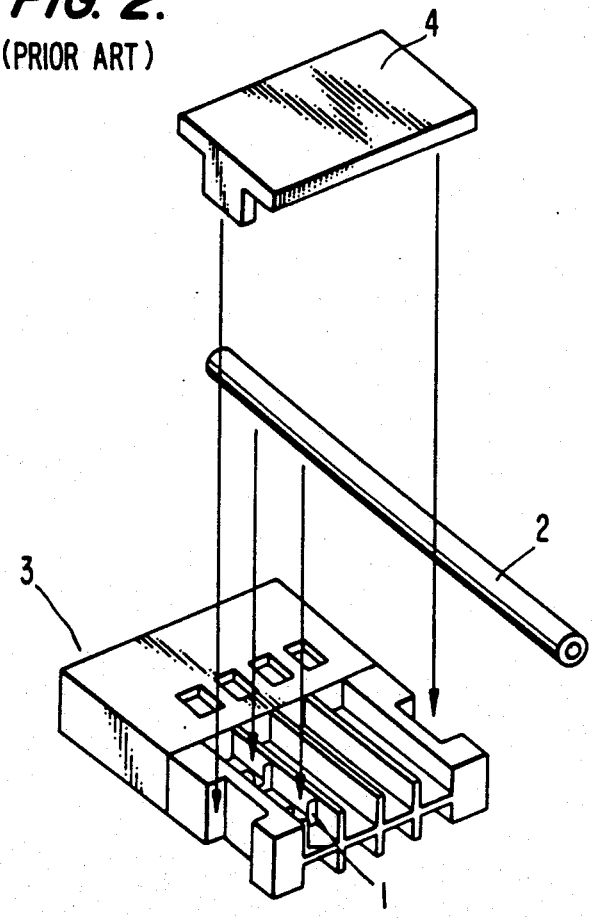
FIG. 2. (PRIOR ART)
FIG. 2 shows another prior art type of cable connector, wherein the contact terminals are embedded in the housing.

In the manner described above, each hole 15 of housing 3 may initially be provided with a respective contact terminal. The contact terminals 1 are initially temporarily held in their first positions. The insertion of contact terminals 1 into respective holes 15 of the housing 1 to their first positions is hereinafter referred to as pre-loading, and the state of the connector in such state is referred to as the pre-loaded state. The connector can be delivered to the user in such a pre-loaded state. Thus, neither the vendor nor the user need worry about the number of the contact terminals necessary for each cable connector. This is similar to the second type connector as described with reference to FIG. 2.

To assemble the cable and the connector, a cable 2 is first aligned with its corresponding deck 12 on which a contact terminal 1 is held in its first position, as shown in FIG. 3. Then the cable 2 is pressed downwardly onto the connector so that the blades 8 pierce through the cable coating 9 and bite into the wire 10 to make contact therewith. Contemporaneously, the holding member 11 is bent so as to embrace the cable. This process is similar to the conventional procedure for assembling cables in ordinary IDC type connectors. Since the holding members 11 are now bent, it is possible to push the contact terminal 1 further into the hole 15. So, as shown in FIG. 4(*a*), contact terminal 1" is pushed into lower hole 15" until the tip 17 of contact part 6" (female jack in this embodiment) reaches the end of lower hole 15" and spring 7" reaches lower window 18" and engages therein. As can be seen in FIG. 3, windows 18 are positioned in upper wall 14 of housing 3 so that they can catch the distal ends of spring 7 in such manner. Thus, contact terminal 1" cannot be pulled out of its second position without first pushing the end of spring 7" out of window 18". As can be seen in FIG. 4(*a*), windows 16 and 18 are of a size such that the distal ends of the springs 7 do not protrude out of the windows. This is important to insulate the contact terminals 1 from their surroundings. But the size of windows 16 and 18 must also be sufficient to prevent each terminal 1 from being pulled out of the corresponding hole 15 in which it is installed.

In like manner, the remaining contact terminals are assembled with their respective cables, and the cable connector is completed. As can be seen in FIG. 4(*a*), the height of holes 15 at the ends thereof remote from decks 12 (in the left hand side in the figure) is less than the height of holes 15 at their entrances adjacent decks 12 (right hand side). A slanted surface 14', 14" is provided between the larger and smaller portions of holes 15. This shape of the holes 15 is designed to accommodate the outside configuration of contact part 6. Thus, each contact part 6 is fixed precisely in a position in alignment with an opening 19 provided in the housing 3 to present a socket for an external lead. FIG. 4(*b*) illustrates the front view of the connector taken in the direction of the arrow B in FIG. 4(*a*).

Figure 5:
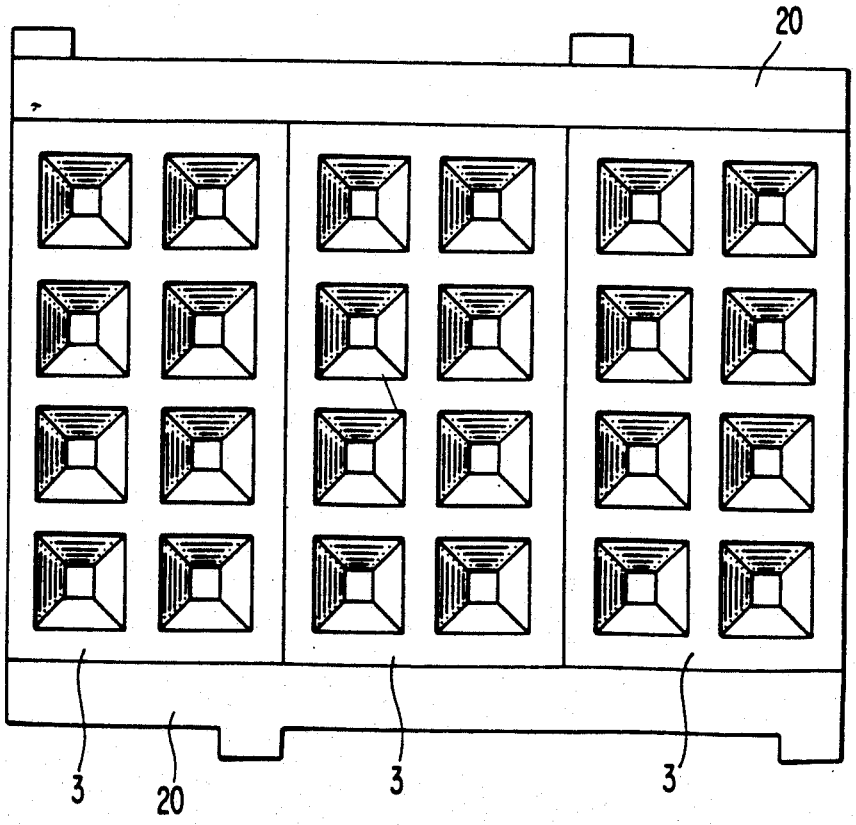
FIG. 5 is a front view of a complex cable connector formed using three modules.

In the embodiment of FIGS. 4(*a*) and 4(*b*), the connector has eight contacts arranged in two rows. But it will be clear that the arrangement of contacts may easily be varied and various modifications are possible. But from a practical view point, the arrangement of contacts as shown in the embodiment of FIGS. 4(*a*) and 4(*b*) is very convenient. If one arrangement, for example as shown in FIG. 4(*b*), is made a standard, its housing may be used as a module. By combining several such modular housings, it is possible to form further varieties of complex connectors. An example of such complex connector is shown in FIG. 5 which shows a front view of the complex connector as seen from its socket side. In this embodiment, three modular housings 3 are combined into a single unit by a shell 20. The combined complex connector has twenty four contacts arranged in four rows. If further modules are added on each side of this embodiment, a larger connector is provided. On the other hand, if only two modules are combined, the connector becomes a square having sixteen contacts. Further, if such modules are arranged in side by side relationship, a flat connector having two rows of contacts is provided. Other variations may be possible simply by varying the shell 20 to combine the modules in different ways.

Figure 6:
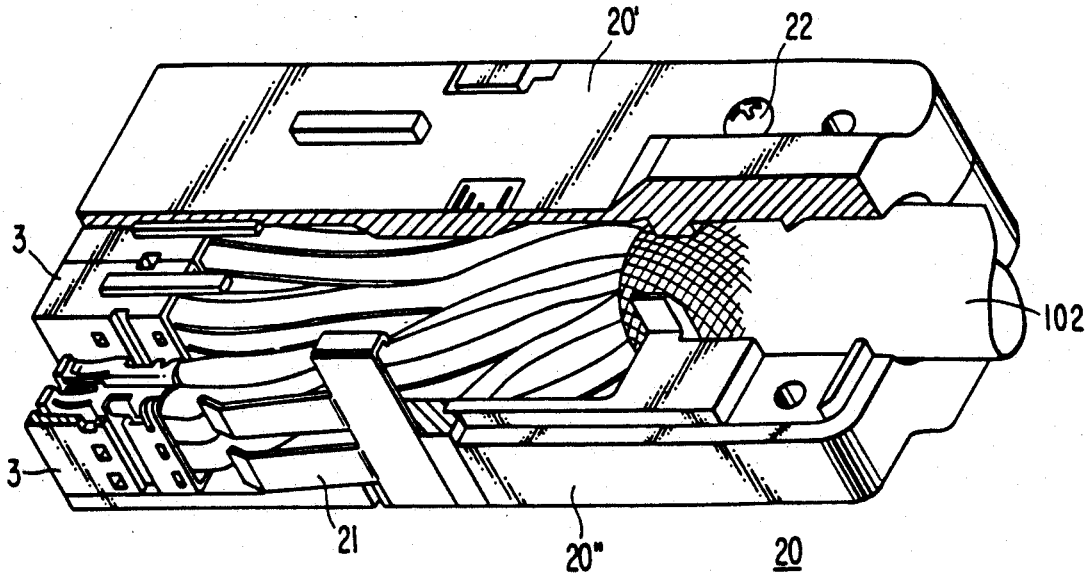
FIG. 6 is a partially cutaway perspective view of an embodiment of the present invention, illustrating the manner in which the housing modules and cables may be mounted in a case to form a complex cable connector.

FIG. 6 is a partially cutaway perspective view of such combined connector. In this embodiment, five modules 3 are packed in a shell 20, to provide forty contacts corresponding to the forty individual cables 2 of a multicable line 102. The shell 20 is divided into two parts, the upper shell 20' and the lower shell 20", which are joined by screws 22. After the wiring of the cables to respective housings has been completed, the housings are placed in proper position. A hook 21 is provided on the shell 20 to fasten the connector to the opposing socket or chassis (not shown). The construction of the shell 20 may be an ordinary one, and is not specifically related to the invention, therefore, further description is omitted for the sake of simplicity.

Usually, it is difficult to wire the individual cables to the inner parts of a connector having a large number of contacts. So, prior art cable connectors have been large in order to enable wiring of the terminals positioned in the interior portions of the connector. Another solution was to provide a flat type connector. But by using the housing configuration provided by the present invention, it is easy to wire the cables to the interior portions of the connector, since each of the modules can be wired separately and then the same may be combined into a single unit. This makes it possible to provide a small size and high density connector that has many contacts.

Figure 7B:
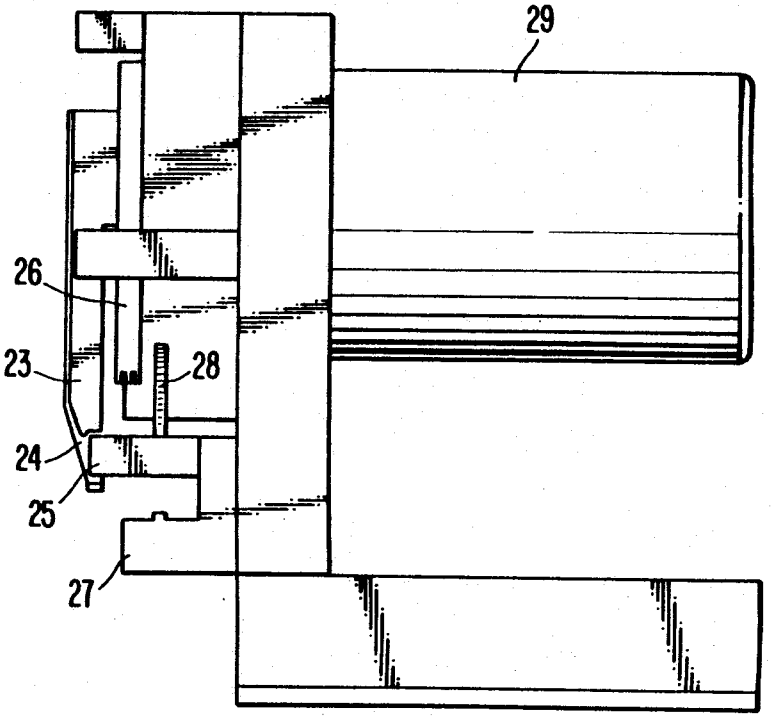
FIGS. 7(*a*) and 7(*b*) are respective front and side elevational views schematically illustrating a machine for assembling cables to the cable connector of the present invention.
Figure 7A:
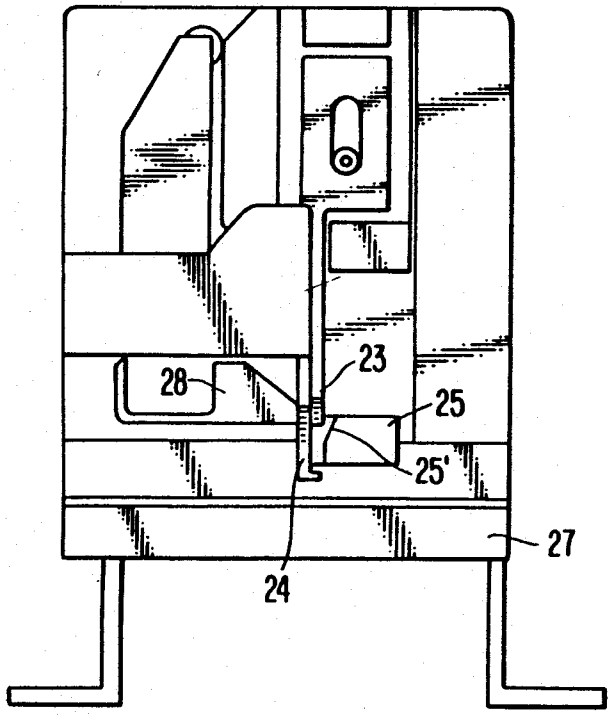
Figure 9A:
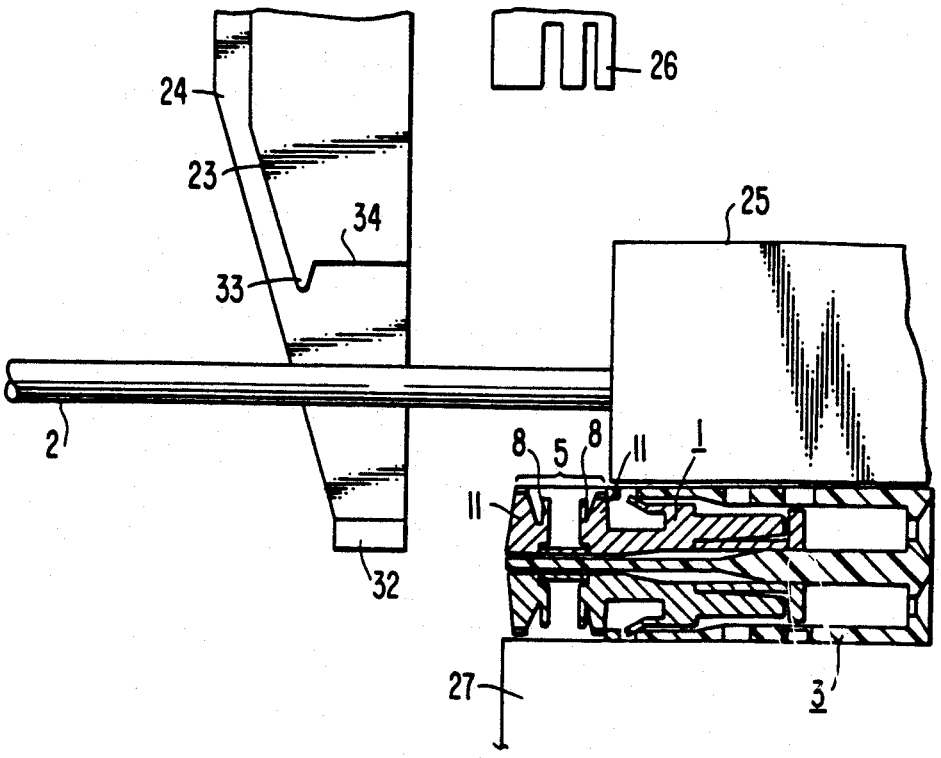
FIG. 9(*a*) through (*d*) are schematic views illustrating the steps of assembling the cable to the cable connector.
Figure 9B:
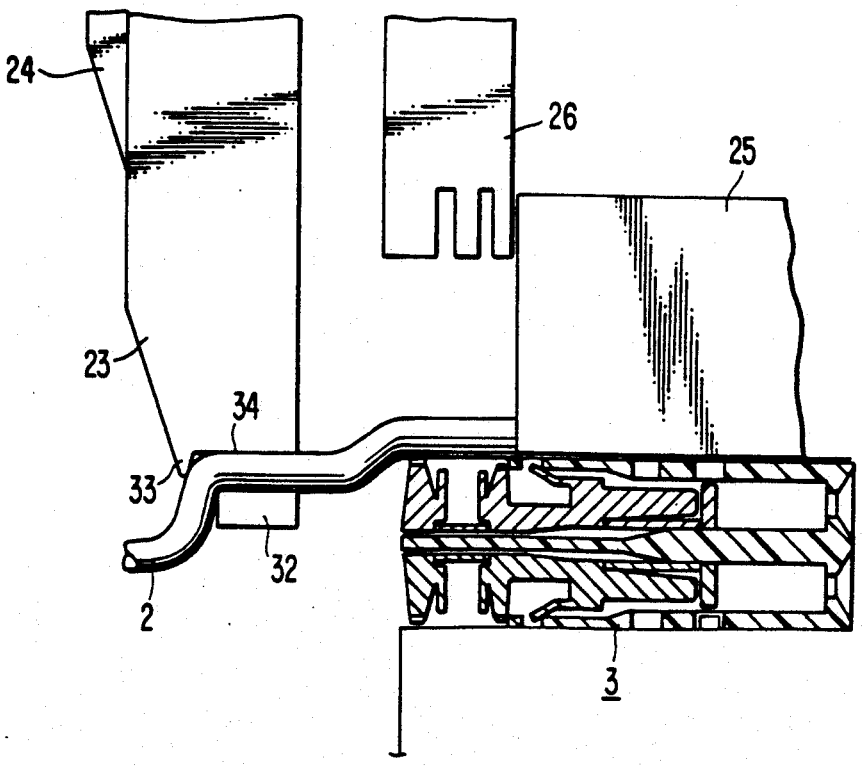
Figure 9C:
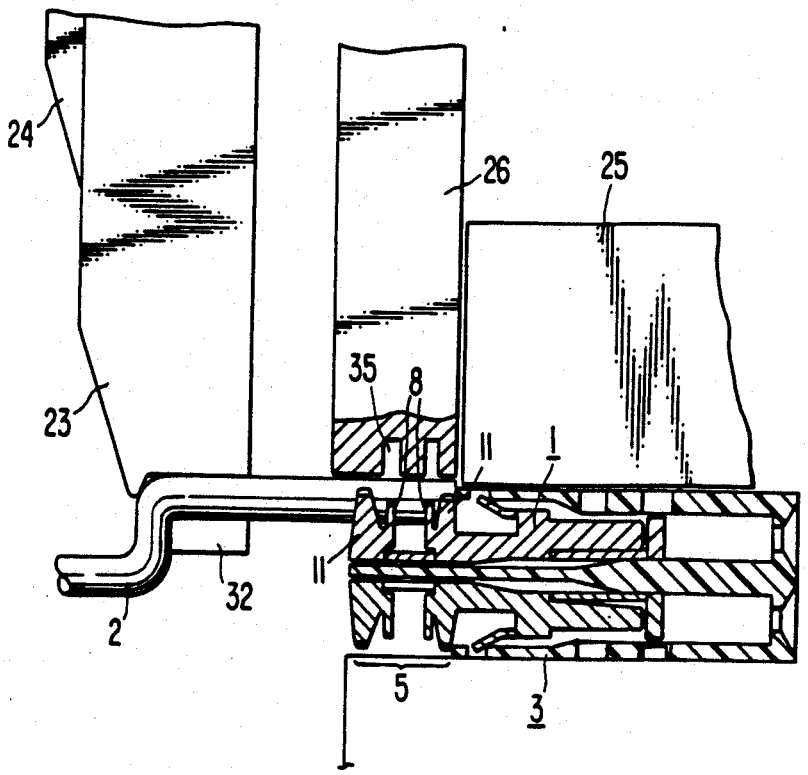
Figure 9D:
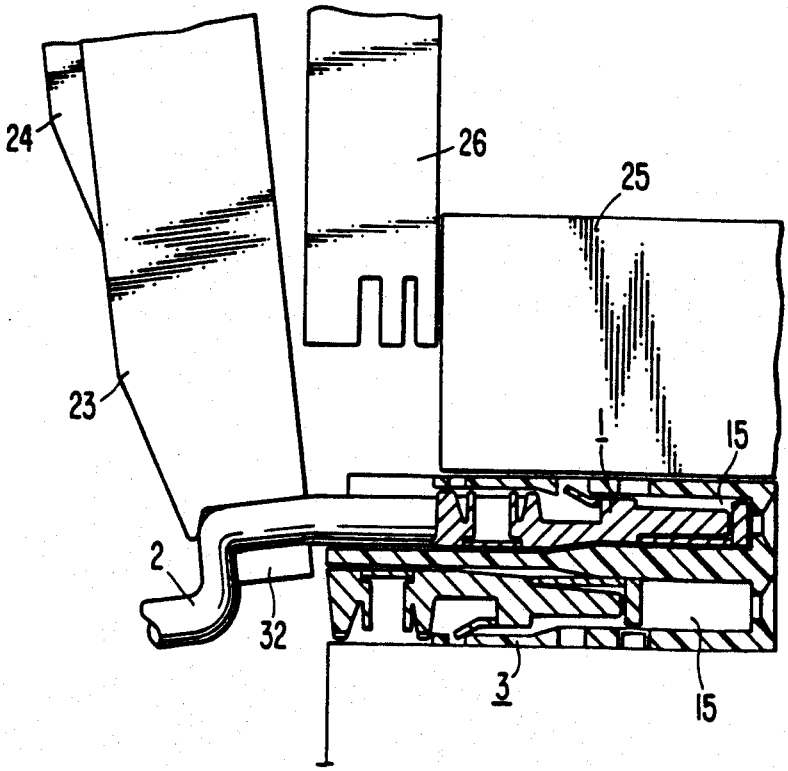

A machine for assembling the cables to the cable connector will be described briefly hereinafter. FIGS. 7(*a*) and 7(*b*) show schematically an example of a machine designed for assembling the cable connector of the present invention. FIG. 7(*a*) is a front view of the machine and FIG. 7(*b*) is a side view of the machine schematically illustrating the relationship of the main parts of the machine. In FIGS. 7(*a*) and 7(*b*), the reference numerals 23 and 24 designate cable clampers. The cable clamper 23 is movable up and down to clamp the cable, and both cable clampers 23 and 24 are movable horizontally to push the contact terminal 1 into the housing. A cable guide 25 is provided with a taper 25' for guiding the cable to the assembly position. A punch 26 is provided for pressing the cable toward the contact terminal of the connector. The housing is loaded on a base 27 and hook 28 shifts the housing by the pitch of the terminal spacing after the wiring to each terminal is finished. A mechanism for moving these parts and a controller for controlling the timing and sequence of their respective motions are each installed in a case 29. As will be described below, the motions of these parts are simple and conventional, so a description of the mechanism for driving these parts is omitted.

Figure 8:
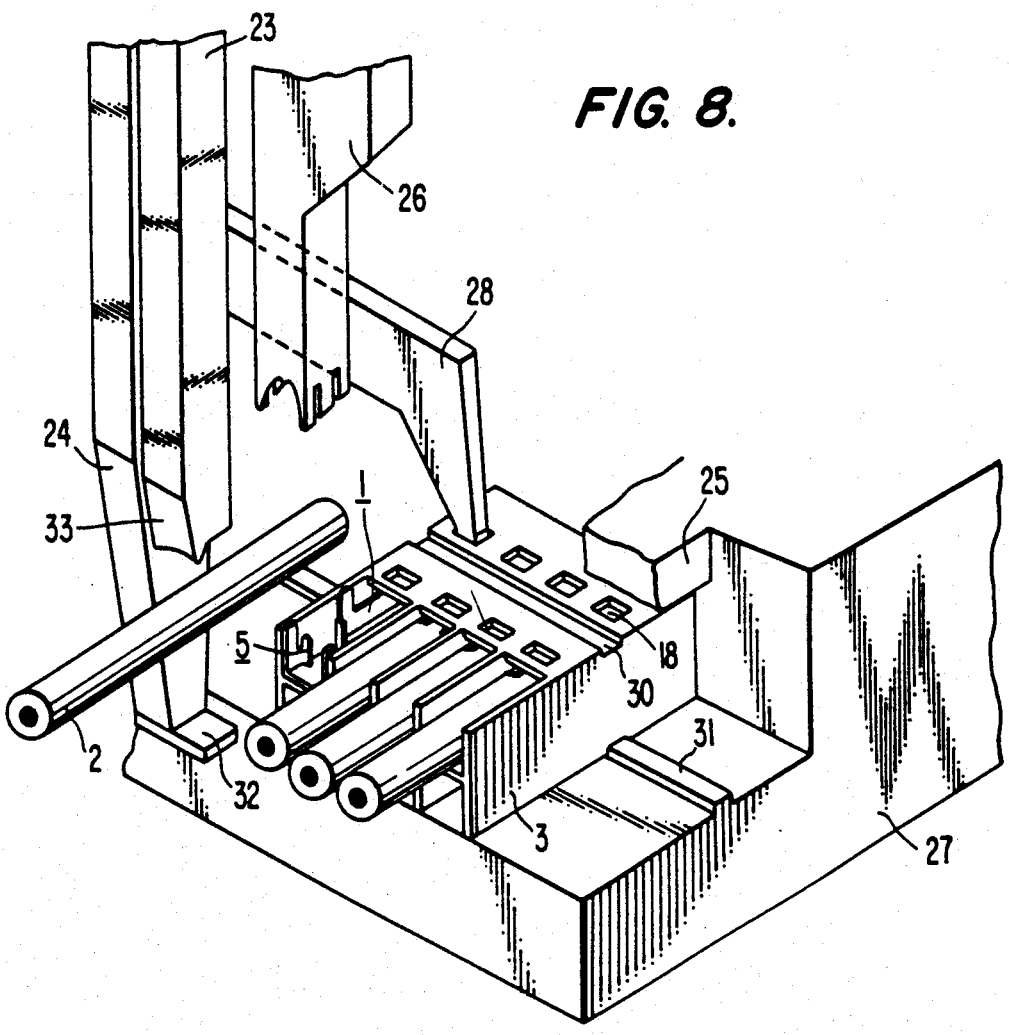
FIG. 8 is an enlarged perspective view of the machine of FIGS. 7(*a*) and 7(*b*) with parts broken away for illustrating the mechanism thereof.

The specific motions of the parts described in the foregoing paragraph will be described referring to FIG. 8 and FIG. 9. FIG. 8 is an enlarged perspective view with some parts broken away for illustrating the main parts of the assembling machine of FIG. 7. The housing 3 is mounted on the base 27 with the groove 30 formed on the upper and lower surface of the housing 3 aligned with a rail 31 formed on the base 27. The hook 28 holds one of the windows 18. So, the position of the housing 3 is fixed on the base 27. As mentioned before, the housing is pre-loaded with each contact terminal 1 at its first position. Though the cable guide 25 is broken away in FIG. 8, it is to be understood that the tapered parts 25' (FIG. 7) lead the cables 2 over the connection parts 5 of the contact terminals 1. A side view of this situation is illustrated in FIG. 9(*a*). The cable guide 25 is partially broken away in FIG. 9(*a*), but it is to be understood that guide 25 also fixes the axial position of cable 2 as illustrated. At the same time, the cable guide 25 holds the housing 3 pressing it toward the base 27.

Next, as shown in FIG. 9(*b*), the cable clamper 23 goes down. As can be seen in FIG. 8, the tip 33 of the cable clamper is concave, so it holds the cable 2 at center of the cable clamper 23. As seen in FIG. 8, there is a side projection 32 on the tip of the cable clamper 24, and the tip 33 and the side projection 32 are disposed on opposite sides of the cable 2 so that during operation, as shown in FIG. 9(*b*), the cable is held between the side projection 32 and the flat part 34 of the tip of the cable clamper 23. At the same time, the wire 2 is bent by tip 33 as shown in FIG. 9(*b*).

Successively, the punch 26 goes down as shown in FIG. 9(*c*). The tip of the punch 26 is provided with grooves 35 positioned to receive the blades 8 when the punch 26 pushes the cable 2 downward into the connection part 5 of the contact terminal 1. Since the tip of the punch 26 is concave as shown in FIG. 8, it bends the holding member 11 around the cable 2 so as to embrace the cable tightly.

Then, the punch 26 goes up as shown in FIG. 9(*d*). Following that, the cable clampers 23 and 24 move horizontally toward the housing 3. In practice, clampers 23 and 24 are disposed at a slight angle relative to housing 3, as shown in FIG. 9(*d*). Thus, the contact terminal 1 is pushed into the hole 15 of the housing and positioned at its second position as described before. As can be seen in FIG. 9(*d*), the contact terminal 1 is now entirely covered by the housing. In such a manner, the assembling of the wire to the cable connector is completed. And the machine goes back to the state as illustrated in FIG. 9(*a*). The cable guide 25 frees the housing, and the hook 28 shifts the housing 3 by one pitch of the wiring. Then, the wiring for the next terminal begins.

The wire assembler described above is but an example, and it will be possible for one skilled in the art to design various types of such machines. Although the machine itself is not included in the scope of the invention, it must be pointed out that by adopting the configuration of the cable connector of the invention and applying an assembly method as disclosed above, it becomes very simple to assemble the cables to the connector. There is no need for preparing the necessary number of contact terminals for each of the cable connectors, and there is no need to worry about the contact terminals coming loose during transportation of the connector. Since, a cover for the contact terminals is unnecessary, the size of the cable connector is further reduced, and machines, equipment and labor for fitting such cover are eliminated. Accordingly, the costs of assembling machines and labor are saved. This has great merit both from the view point of the vendor and the view point of the user of the connector.

We claim:

1. A cable connector having a plurality of contact parts for engagement with respective corresponding counter contact parts of an opposite connector, said cable connector comprising:

a plurality of separable, elongated, metallic contact terminals, each of which is provided with, a contact part at one end of the contact terminal for contacting a corresponding contact part of the opposite connector, said contact part of the cable connector having a cross-sectional configuration presenting a width and a height, and an elongated connection part provided at the opposite end of said contact terminal and adapted for connection to a cable;

a housing made from an insulator material for receiving and holding said contact terminals, said housing being provided with an outer wall, a floor wall, spaced side walls and at least one internal wall parallel to said side walls, said walls defining a plurality of holes, said holes corresponding respectively to said contact terminals for receiving the latter separately and holding them separated from each other, said outer wall being cut away at one end of the housing so as to expose said floor wall and present an open deck therefrom disposed in front of each hole, adjacent decks being separated by an internal wall; and pre-loading means for holding each contact terminal at respective first and second positions in the housing, said connection part of the contact terminal being positioned on the open deck in an exposed condition when the terminal is in its first position, and said connection part of said contact terminal being entirely covered by said outer wall of said housing when the terminal is in its second position.

2. A cable connector according to claim 1, wherein said pre-loading means comprises:

a leaf spring provided at the central portion of each said contact terminal, the normal height of said spring being higher than the height of the hole in the housing into which the corresponding contact terminal is inserted;

a respective first window formed in a wall of said housing and positioned so as to receive said spring when said contact terminal is received by said housing and positioned in its first position; and a respective second window formed in a wall of said housing and positioned so as to receive said spring when said contact terminal is inserted into the hole of said housing and positioned in its second position.

3. A cable connector according to claim 1, wherein each said connection part comprises:

blade means formed integrally with the corresponding contact terminal, said blade means including at least one blade adapted to pierce through a cable coating to bite into the core wire of said cable and make electric contact therewith when the cable is pressed into said connection part; and a plurality of holding members formed integrally with the corresponding contact terminal, said holding members being bendable for embracing the cable to tightly hold the cable when the cable is connected to said connection part of said contact terminal, the initial height of said holding members before bending being higher than the height of the corresponding hole in the housing into which the contact terminal is inserted.

4. A cable connector according to claim 1, wherein the cross-section of each hole in the housing is smaller at its deeper part than at its entrance part, there being a tapering portion at the middle of each hole interconnecting said parts, said deeper part being configured so as to tightly contact the outside of the contact part of the corresponding contact terminal when the latter is positioned in its second position.

5. A cable connector as set forth in claim 1, wherein the length of each deck is substantially the same as the length of the corresponding connection part, the width of each deck and hole is substantially the same as the width of the corresponding contact part and the height of each hole is substantially the same as the height of the corresponding contact part.

6. A cable connector as set forth in claim 1, wherein said housing has two outer walls disposed on respective opposite sides of the floor wall so as to present a respective row of said holes on each side of the floor wall.

7. A cable connector having a plurality of contact parts for engagement with respective corresponding counter contact parts of an opposite connector, said cable connector being composed of a plurality of modules and a shell combining the modules into a single cable connector, each said module comprising:

a plurality of separable, elongated, metallic contact terminals, each of which is provided with, a contact part at one end of the contact terminal for contacting the corresponding counter contact part of the opposite connector, said contact part of the cable connector having a cross-sectional configuration presenting a width and a height, and an elongated connection part provided at the opposite end of said contact terminal and adapted for connection to a cable;

a housing made from an insulator material for receiving and holding said contact terminals, said housing being provided with an outer wall, a floor wall, spaced side walls and at least one internal wall parallel to said side walls, said walls defining a plurality of holes, said holes corresponding respectively to said contact terminals for receiving the latter separately and holding them separated from each other, said outer wall being cut away at one end of the housing so as to expose said floor wall and present an open deck therefrom disposed in front of each hole, adjacent decks being separated by an internal wall; and pre-loading mean for holding each contact terminal at respective first and second positions in said housing, said connection part of the contact terminal being positioned on the open deck in an exposed condition when the terminal is in its first position, and said connection part of said contact terminal being entirely covered by said outer wall of said housing when the terminal is in its second position.

8. A cable connector according to claim 7, wherein said pre-loading means comprises:

a leaf spring provided at the central portion of each said contact terminal, the normal height of said spring being higher than the height of the hole in the housing into which the corresponding contact terminal is inserted;

a respective first window formed in a wall of said housing and positioned so as to receive said spring when said contact terminal received by said housing and positioned in its first position; and a respective second window formed in a wall of said housing and positioned so as to receive said spring when said contact terminal is inserted into the hole of said housing and positioned in its second position.

9. A cable connector according to claim 7, wherein each said connection part comprises:

blade means formed integrally with the corresponding contact terminal, said blade means including at least one blade adapted to pierce through a cable coating to bite into the core wire of said cable and make electric contact therewith when the cable is pressed into said connection part; and a plurality of holding members formed integrally with the corresponding contact terminal, said holding members being bendable for embracing the cable to tightly hold the cable when the cable is connected to said connection part of said contact terminal, the initial height of said holding members before bending being higher than the height of the corresponding hole in the housing into which the contact terminal is inserted.

10. A cable connector as set forth in claim 7, wherein the cross-section of each hole in the housing is smaller at its deeper part than at its entrance part, there being a tapering portion at the middle of each hole interconnecting said parts, said deeper part being configured so as to tightly contact the outside of the contact part of the corresponding contact terminal when the latter is positioned in its second position.

11. A cable connector as set forth in claim 7, wherein the length of each deck is substantially the same as the length of the corresponding connection part, the width of each deck and hole is substantially the same as the width of the corresponding contact part and the height of each hole is substantially the same as the height of the corresponding contat part.

12. A cable connector as set forth in claim 7, wherein said housing has two outer walls disposed on respective opposite sides of the floor wall so as to present a respective row of said holes on each side of the floor wall.

* * * * *

UNITED STATES PATENT AND TRADEMARK OFFICE

CERTIFICATE OF CORRECTION

PATENT NO. : 4,797,119

DATED : January 10, 1989

INVENTOR(S) : Hideo Miyazawa, Ikuhiro Andoh, Hiromichi Koyama and Mitsuru Kobayashi It is certified that error appears in the above-identified patent and that said Letters Patent is hereby corrected as shown below:

On the Title Page,

Item [73] "Kawasak" should be --Kawasaki--.

Column 2, line 67, "desription" should be --description--.

Signed and Sealed this

Second Day of May, 1989

*Attest:*

*Attesting Officer*

DONALD J. QUIGG

*Commissioner of Patents and Trademarks*